US008475606B2

(12) United States Patent
Eckert

(10) Patent No.: US 8,475,606 B2
(45) Date of Patent: Jul. 2, 2013

(54) IN-SITU OXIDIZED THERMALLY APPLIED CERAMIC COATING

(76) Inventor: C. Edward Eckert, New Kensington, PA (US)

( * ) Notice: Subject to any disclaimer, the term of this patent is extended or adjusted under 35 U.S.C. 154(b) by 1689 days.

(21) Appl. No.: 11/891,470

(22) Filed: Aug. 10, 2007

(65) Prior Publication Data

US 2012/0175024 A1 Jul. 12, 2012

(51) Int. Cl.
*C23C 8/10* (2006.01)
*H05B 3/60* (2006.01)

(52) U.S. Cl.
USPC ..... 148/285; 148/277; 219/548

(58) Field of Classification Search
USPC ..... 148/277, 285; 219/548
See application file for complete search history.

(56) References Cited

U.S. PATENT DOCUMENTS

| | | | | |
|---|---|---|---|---|
| 389,729 | A | 9/1888 | Weist | 338/225 |
| 412,449 | A | 10/1889 | Askew | 338/225 |
| 527,324 | A | 10/1894 | Davis | 219/553 |
| 543,800 | A | 7/1895 | Davis | 338/224 |
| 1,086,726 | A | 2/1914 | Opsahl | 338/224 |
| 1,263,181 | A | 4/1918 | Winger | 338/225 |
| 1,338,294 | A | 4/1920 | Gardner | 252/509 |
| 1,473,107 | A | 11/1923 | Kohn | 252/504 |
| 1,610,820 | A | 12/1926 | Steward et al. | 252/509 |
| 1,681,736 | A | 8/1928 | Kull | 219/552 |
| 1,947,692 | A | 2/1934 | Beyer | 252/504 |
| 2,905,919 | A | 9/1959 | Lorch et al. | 338/224 |
| 5,850,072 | A | 12/1998 | Eckert | 219/523 |
| 5,850,073 | A | 12/1998 | Eckert | 219/523 |
| 5,894,541 | A | 4/1999 | Eckert | 392/503 |
| 5,963,580 | A | 10/1999 | Eckert | 373/42 |
| 5,968,223 | A | 10/1999 | Eckert | 75/10.1 |
| 6,066,289 | A | 5/2000 | Eckert | 266/235 |
| 6,069,910 | A | 5/2000 | Eckert | 373/42 |
| 6,444,165 | B1 | 9/2002 | Eckert | 266/196 |
| 6,470,041 | B2 | 10/2002 | Eckert | 373/119 |
| 6,850,551 | B1 | 2/2005 | Eckert | 373/42 |
| 6,872,924 | B2 | 3/2005 | Eckert | 219/548 |
| 7,033,538 | B2 | 4/2006 | Eckert | 266/196 |
| 2005/0145618 | A1* | 7/2005 | Eckert | 219/548 |

* cited by examiner

*Primary Examiner* — Lois L. Zheng
(74) *Attorney, Agent, or Firm* — Gary P. Topolosky

(57) ABSTRACT

Rendering a refractory coating on a metal substrate impenetrable by molten metal.

8 Claims, 3 Drawing Sheets

IN-SITU OXIDIZED THERMALLY APPLIED CERAMIC COATING

BACKGROUND OF THE INVENTION

This invention relates to ceramic coatings, and more particularly, it relates to ceramic coatings that are in-situ thermally oxidized to improve their resistance to molten metal, such as molten aluminum.

Non-metallic barrier coatings are applied to metallic substrata for the purpose of protecting the substrata from chemical reaction. Such protection depends on the contiguity of the coating for protection. Discontinuities in the coating can permit the transport of chemical species or agents to the underlying substrate surface where chemical reactions may occur and result in failure of the substrate. Such discontinuities include porosity within the coating and cracks, both pre-existing and those that develop in-service.

Heaters used for molten aluminum are usually enclosed in ceramic tubes. Such electric heaters are very expensive and are very inefficient in transferring heat to the melt because of the air gap between the heater and the tube. Also, such electric heaters have very low thermal conductivity values that are characteristic of ceramic materials. In addition, the ceramic tube is fragile and subject to cracking. Thus, there is a great need for an improved ceramic coatings suitable for use with heaters for molten aluminum, for example, having improved resistance to attack by the molten metal and which is efficient in transferring heat to the melt. The present invention provides such ceramic coating.

SUMMARY OF THE INVENTION

It is an object of the invention to provide an improved electric heater assembly.

It is another object of the invention to provide an improved electric heater assembly for use in molten metal such as molten aluminum.

Yet, another object of this invention is to provide an improved electric heater assembly for use in molten metal, the electric heater assembly having a protective sleeve that has intimate contact with the heat transfer media to efficiently transfer heat from the heating media.

And yet, another object of the invention is to provide an improved electric heater assembly for use in molten metal, the electric heater assembly having a protective sleeve having a thermal conductivity of less than 30 BTU/ft hr° F. and having a thermal expansion coefficient of less than $15\times10^{-6}$ in/in/° F. and having a chilling power of less than 5000 $BTU^2/ft^4$ hr° F.

And yet, it is a further object of the invention to provide an improved electric heater assembly for use in molten metal, the electric heater assembly having a protective sleeve comprised of a material resistant to erosion or dissolution by molten metal such as molten aluminum.

These and other objects will become apparent from the specification, drawings and claims appended hereto.

In accordance with these objects, there is disclosed an electric heater assembly for heating molten metal, the assembly comprised of a tubular sleeve suitable for immersing in molten metal, the sleeve comprised of a metal or a metal composite material and having an inside surface. A body of a copper-containing material is contained in the sleeve, the body in contact with the inside surface of the sleeve to improve heat transfer through the sleeve. The copper-containing material has the ability to flow by creep deformation at operating temperatures to eliminate air pockets between the inside surface and the copper-containing material, the body having at least one electric heating element receptacle. An electric heating element is located in the receptacle in heat transfer relationship therewith for adding heat through said body to the molten metal.

The heater assembly may be used for a heating a body of molten metal, e.g., aluminum or other fluid media, contained in a heating bay comprising the steps of providing a body of molten metal. An electric heater assembly is projected into the molten metal. The assembly comprises a tubular sleeve suitable for immersing in the molten metal, the sleeve comprised of a metal or a metal composite material and having an inside surface. A body of a copper-containing material is contained in the sleeve, the body in contact with the inside surface to improve heat transfer through the sleeve, the copper-containing material having the ability to flow by creep deformation at operating temperatures to eliminate air pockets between the inside surface and the copper-containing material, the body having at least one electric heating element receptacle. An electric heating element is located in the receptacle in heat transfer relationship therewith for adding heat through the body to the molten metal. An electric current is passed through the element and heat is added to the body of molten metal.

The heater assembly may be used for heating fluid material where a refractory coating is not required. Thus, the electric heater assembly comprises a tubular sleeve, the sleeve comprised of a metal and having an inside surface. A body of a copper-containing material is contained in the sleeve, the body in contact with the inside surface to improve heat transfer through the sleeve, the copper-containing material having the ability to flow by creep deformation at operating temperatures to eliminate air pockets between the inside surface and the copper-containing material, the body having at least one electric, preferably multiple, heating element receptacles. Electric heating elements are located in the receptacles in heat transfer relationship therewith for adding heat through the body.

Also, there is disclosed a method of rendering a refractory coating on a metal substrate impenetrable by molten metal, the method comprising the steps of applying a refractory coating to a metal substrate, stressing the coating to relax residual stresses, and then infiltrating a metal or alloy thereof into cracks or pores in the refractory coating to a depth which avoids reaction with the metal substrate. The metal infiltrated into cracks and pores is converted to an oxide which occupies the cracks and pores, thereby rendering the refractory coating impenetrable by molten metal.

Also disclosed is a method of rendering a refractory coating on a metal substrate impenetrable by molten metal. The method comprises the steps of applying a refractory coating to a metal substrate, such as a heater tube, stressing the coating to relax residual stresses, and then infiltrating a metal or alloy thereof into cracks or pores in the refractory coating to a depth which avoids reaction with the metal substrate. The metal infiltrated in the cracks and pores is converted to an oxide which occupies the cracks and pores, thereby rendering the refractory coating impenetrable by molten metal.

DETAILED DESCRIPTION OF PREFERRED EMBODIMENTS

Figure 1:
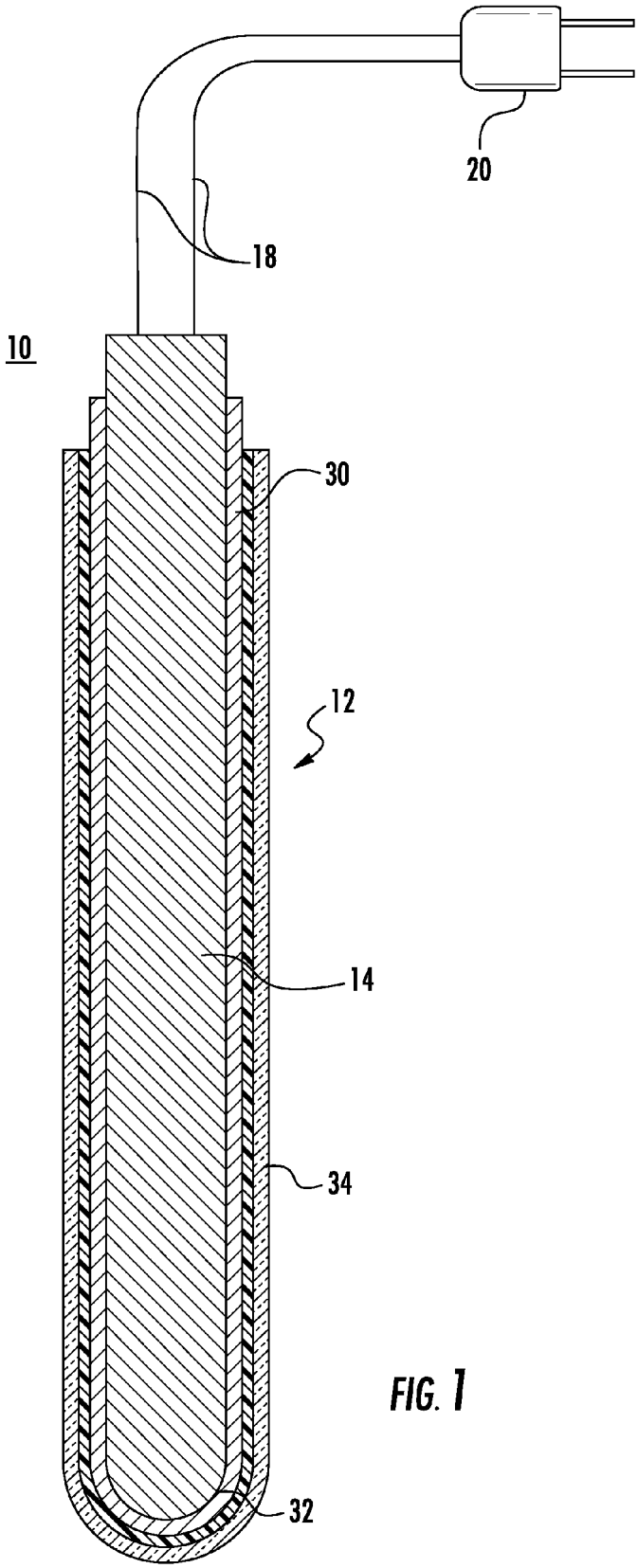
FIG. 1 is a cross-sectional view of an electric heater assembly in accordance with the invention.

Referring to FIG. 1, there is shown a schematic of an electric heater assembly 10 in accordance with the invention. The electric heater assembly is comprised of a protective sleeve 12 and an electric heating element 14 when the heater is used for heating molten metal. A lead 18 extends from electric heating element 14 and terminates in a plug 20 suitable for plugging into a power source.

Preferably, protective sleeve 12 is comprised of titanium tube 30 having a closed end 32. While the protective sleeve is illustrated as a tube, it will be appreciated that any configuration that protects or envelops electric heating element 14 may be employed. Thus, reference to tube herein is meant to include such configurations. A refractory coating 34 is employed which is resistant to attack by the environment in which the electric heater assembly is used. A bond coating may be employed between the refractory coating 34 and titanium tube 30.

While it is preferred to fabricate tube 30 out of a titanium base alloy, tube 10 may be fabricated from any metal or metalloid material suitable for contacting molten metal and which material is resistant to dissolution or erosion by the molten metal. Other materials that may be used to fabricate tube 30 include silicon, niobium, chromium, molybdenum, combinations of NiFe (364 NiFe) and NiTiC (40 Ni 60 TiC), Ni—Fe (36% Ni—Fe), Ni—Co—Fe (28 Ni-18 CO—Fe)$_1$, particularly when such materials have low thermal expansion and low chilling power, all referred to herein as metals. For protection purposes, it is preferred that the metal or metalloid be coated with a material such as a refractory resistant to attack by molten metal and suitable for use as a protective sleeve.

Further, the material of construction for tube 30 should have a thermal conductivity of less than 30 BTU/ft hr° F., and preferably less than 15 BTU/ft hr° F., with a most preferred material having a thermal conductivity of less than 10 BTU/ft hr° F. Another important feature of a desirable material for tube 30 is thermal expansion. Thus, a suitable material should have a thermal expansion coefficient of less than $15\times10^{-6}$ in/in/° F., with a preferred thermal expansion coefficient being less than $10\times10^{-6}$ in/in/° F., and the most preferred being less than $5\times10^{-6}$ in/in/° F. Another important feature of the material useful in the present invention is chilling power. Chilling power is defined as the product of heat capacity, thermal conductivity and density. Thus, preferably the material in accordance with the invention has a chilling power of less than 5000 BTU$^2$/ft$^4$ hr° F., preferably less than 2000 BTU$^2$/ft$^4$ hr° F., and typically in the range of 100 to 750 BTU$^2$/ft$^4$ hr° F.

As noted, the preferred material for fabricating into tubes 30 is a titanium base material or alloy having a thermal conductivity of less than 30 BTU/ft hr° F., preferably less than 15 BTU/ft hr° F., and typically less than 10 BTU/ft hr° F., and having a thermal expansion coefficient less than $15\times10^{-6}$ in/in/° F., preferably less than $10\times10^{-6}$ in/in/° F., and typically less than $5\times10^{-6}$ in/in/° F. The titanium material or alloy should have chilling power as noted, and for titanium, the chilling power can be less than 500, and preferably less than 400, and typically in the range of 100 to 300 BTU/ft$^2$ hr° F.

When the electric heater assembly is being used in molten metal such as lead, for example, the titanium base alloy need not be coated to protect it from dissolution. For other metals, such as aluminum, copper, steel, zinc and magnesium, refractory-type coatings should be provided to protect against dissolution of the metal or metalloid tube by the molten metal.

For most molten metals, the titanium alloy that should be used is one that preferably meets the thermal conductivity requirements, the chilling power and the thermal expansion coefficient noted herein. Further, typically, the titanium alloy should have a yield strength of 30 ksi or greater at room temperature, preferably 70 ksi, and typical 100 ksi. The titanium alloys included herein and useful in the present invention include CP (commercial purity) grade titanium, or alpha and beta titanium alloys or near alpha titanium alloys, or alpha-beta titanium alloys. The titanium-base alloy can be a titanium selected from the group consisting of 6242, 1100 and commercial purity (CP) grade. The alpha or near-alpha alloys can comprise, by wt. %, 2 to 9 Al, 0 to 12 Sn, 0 to 4 Mo, 0 to 6 Zr, 0 to 2 V and 0 to 2 Ta, and 2.5 max. each of Ni, Nb and Si, the remainder titanium and incidental elements and impurities.

Specific alpha and near-alpha titanium alloys contain, by wt. %, about:

(a) 5 Al, 2.5 Sn, the remainder Ti and impurities.

(b) 8 Al, 1 Mo, 1 V, the remainder Ti and impurities.

(c) 6 Al, 2 Sn, 4 Zr, 2 Mo, the remainder Ti and impurities.

(d) 6 Al, 2 Nb, 1 Ta, 0.8 Mo, the remainder Ti and impurities.

(e) 2.25 Al, 11 Sn, 5 Zr, 1 Mo, the remainder Ti and impurities.

(f) 5 Al, 5 Sn, 2 Zr, 2 Mo, the remainder Ti and impurities.

The alpha-beta titanium alloys comprise, by wt. %, 2 to 10 Al, 0 to 5 Mo, 0 to 5 Sn, 0 to 5 Zr, 0 to 11 V, 0 to 5 Cr, 0 to 3 Fe, with 1 Cu max., 9 Mn max., 1 Si max., the remainder titanium, incidental elements and impurities.

Specific alpha-beta alloys contain, by wt. %, about:

(a) 6 A, 4 V, the remainder Ti and impurities.

(b) 6 Al, 6 V, 2 Sn, the remainder Ti and impurities.

(c) 8 Mn, the remainder Ti and impurities.

(d) 7 Al, 4 Mo, the remainder Ti and impurities.

(e) 6 Al, 2 Sn, 4 Zr, 6 Mo, the remainder Ti and impurities.

(f) 5 Al, 2 Sn, 2 Zr, 4 Mo, 4 Cr, the remainder Ti and impurities.

(g) 6 Al, 2 Sn, 2 Zn, 2 Mo, 2 Cr, the remainder Ti and impurities.

(h) 10 V, 2 Fe, 3 Al, the remainder Ti and impurities.

(i) 3 Al, 2.5 V, the remainder Ti and impurities.

The beta titanium alloys comprise, by wt. %, 0 to 14 V, 0 to 12 Cr, 0 to 4 Al, 0 to 12 Mo, 0 to 6 Zr and 0 to 3 Fe, the remainder titanium and impurities.

Specific beta titanium alloys contain, by wt. %, about:

(a) 13 V, 11 Cr, 3 Al, the remainder Ti and impurities.

(b) 8 Mo, 8 V, 2 Fe, 3 Al, the remainder Ti and impurities.

(c) 3 Al, 8 V, 6 Cr, 4 Mo, 4 Zr, the remainder Ti and impurities.

(d) 11.5 Mo, 6 Zr, 4.5 Sn, the remainder Ti and impurities.

When it is necessary to provide a coating to protect tube 30 of metal or metalloid from dissolution or attack by molten metal, a refractory coating 34 is applied to the outside surface of tube 30. The coating should be applied above the level to which the electric heater assembly is immersed in the molten metal. The refractory coating can be any refractory material, which provides the tube with a molten metal resistant coating. The refractory coating can vary, depending on the molten metal. Thus, a novel composite material is provided permitting use of metals or metalloids having the required thermal conductivity and thermal expansion for use with molten metal, which heretofore was not deemed possible.

When the electric heater assembly is to be used for heating molten metal such as aluminum, magnesium, zinc, or copper, etc., a refractory coating may comprise at least one of alumina, zirconia, yittria stabilized zirconia, magnesia, magnesium titanite, or mullite or a combination of alumina and titania. While the refractory coating can be used on the metal or metalloid comprising the tube, a bond coating can be applied between the base metal and the refractory coating. The bond coating can provide for adjustments between the thermal expansion coefficient of the base metal alloy, e.g., titanium, and the refractory coating when necessary. The bond coating thus aids in minimizing cracking or spalling of the refractory coat when the tube is immersed in the molten metal or brought to operating temperature. When the electric heater assembly is cycled between molten metal temperature and room temperature, for example, the bond coat can be advantageous in preventing cracking, particularly if there is a considerable difference between the thermal expansion of the metal or metalloid and the refractory.

Typical bond coatings comprise Cr—Ni—Al alloys and Cr—Ni alloys, with or without precious metals. Bond coatings suitable in the present invention are available from Metco Inc., Cleveland, Ohio, under the designation 460 and 1465. In the present invention, the refractory coating should have a thermal expansion that is plus or minus five times that of the base material. Thus, the ratio of the coefficient of expansion of the base material can range from 5:1 to 1:5, preferably 1:3 to 1:1.5. The bond coating aids in compensating for differences between the base material and the refractory coating.

The bond coating has a thickness of 0.1 to 5 mils with a typical thickness being about 0.5 mil. The bond coating can be applied by sputtering, plasma or flame spraying, chemical vapor deposition, spraying, dipping or mechanical bonding by rolling, for example.

After the bond coating has been applied, the refractory coating is applied. The refractory coating may be applied by any technique that provides a uniform coating over the bond coating. The refractory coating can be applied by aerosol, sputtering, plasma or flame spraying, for example. Preferably, the refractory coating has a thickness in the range of 0.3 to 42 mils, preferably 5 to 15 mils, with a suitable thickness being about 10 mils. The refractory coating may be used without a bond coating.

In another aspect of the invention, boron nitride may be applied as a thin coating on top of the refractory coating. The boron nitride may be applied as a dry coating, or a dispersion of boron nitride and water may be formed and the dispersion applied as a spray. The boron nitride coating is not normally more than about 2 or 3 mils, and typically it is less than 2 mils.

The heater assembly of the invention can operate at watt densities of 40 to 120 watts/in$^2$.

The heater assembly in accordance with the invention has the advantage of a metallic-composite sheath for strength and improved thermal conductivity. The strength is important because it provides resistance to mechanical abuse and permits an ultimate contact with the internal element. Intimate contact between heating element and sheath inside diameter provides for substantial elimination of an annular air gap between heating element and sheath. In prior heaters, the annular air gap resulted in radiation heat transfer and also backs radiation to the element from inside the sheath wall which limits maximum heat flux. By contrast, the heater of the invention employs an interference fit that results in essentially only conduction.

In conventional heaters, the heating element is not in intimate contact with the protection tube resulting in an annular air gas or space there between. Thus, the element is operated at a temperature independent of the tube. Heat from the element is not efficiently removed or extracted by the tube, greatly limiting the efficiency of the heaters. Thus, in conventional heaters, the element has to be operated below a certain fixed temperature to avoid overheating the element, greatly limiting the heat flux.

The heater assembly of the invention very efficiently extracts heat from the heating element and is capable of operating close to molten metal, e.g., aluminum temperature. The heater assembly is capable of operating at watt densities of 10 to 350 watts/in$^2$. The low coefficient of expansion of the composite sheath, which is lower than the heating element, provides for intimate contact of the heating element with the composite sheath.

In another feature of the invention, a thermocouple (not shown) may be inserted between sleeve 12 and heating element 14. The thermocouple may be used for purposes of control of the heating element to ensure against overheating of the element in the event that heat is not transferred away sufficiently fast from the heating assembly. Further, the thermocouple can be used for sensing the temperature of the molten metal. That is, sleeve 12 may extend below or beyond the end of the heating element to provide a space and the sensing tip of the thermocouple can be located in the space.

Packed particulates (i.e., MgO) are commonly used as a heat transfer medium within an electric resistance heater. MgO is selected in part because of its relatively high thermal conductivity, i.e., ~8 BTU/ft-hr-° F. at 1000° F. This value applies to MgO as a homologous material. In a dense pack particulate form, however, the thermal conductivity of MgO decreases by an order of magnitude to approximately 0.5 BTU/ft-hr-° F. Heaters incorporating MgO as a heat transfer medium are therefore limited to relatively low heat flux unless high internal temperature gradients can be tolerated.

Heat transfer in a packed bed occurs by a combination of conduction and radiation. Conduction is the governing mechanism for intra-particle heat transfer, and this is influenced by the thermal conductivity of the particulate material.

Importantly, however, inter-particle heat transfer occurs predominantly by radiation, which limits the maximum effective thermal conductivity of a packed bed at temperatures under 2000° F.

The limitations of interparticle heat transfer are illustrated in the data below wherein substantial increases in intraparticle conductivity do not result in significant increases in overall bulk heat transfer.

Master Summary-2" K1 Heater $K_{eff}$ Data-Corrected

| Material ID | ID (in) | OD (in) | Gap (ft) | Volts | $V_{RMS}$ | Amps | Power | $T_1$ | $T_2$ | $T_3$ | $T_4$ | DT | EHL (in) | $R_w$ | $K_{eff}$ (BTU/hr-Ft-° F.) |
|---|---|---|---|---|---|---|---|---|---|---|---|---|---|---|---|
| Graphite Cement | 0.75 | 1.38 | 0.026 | 40.6 | 68.9 | 2.66 | 183.3 | 815 | 827 | 682 | 677 | 141.5 | 7.5 | 10.4 | 0.69 |
| Sodium Silicate/SiC | 0.75 | 1.38 | 0.026 | 40.5 | 68.7 | 2.64 | 181.5 | 847 | 860 | 716 | 716 | 137.5 | 7.5 | 10.3 | 0.70 |
| Aremco $Al_2O_3$ | 0.75 | 1.38 | 0.026 | 41.1 | 69.8 | 2.69 | 187.9 | 847 | 847 | 731 | 742 | 110.5 | 7.5 | 10.6 | 0.90 |
| Aremco SiC | 0.75 | 1.38 | 0.026 | 41.6 | 70.7 | 2.79 | 197.4 | 857 | 857 | 750 | 761 | 101.5 | 7.5 | 11.2 | 1.03 |
| SiC Mixes | 0.75 | 1.38 | 0.026 | 41.8 | 71.1 | 2.79 | 198.4 | 1051 | 1066 | 765 | 760 | 296 | 7.5 | 11.2 | 0.36 |
| Cu Powder | 0.75 | 1.38 | 0.026 | 42.1 | 71.6 | 2.777 | 198.5 | 839 | 854 | 760 | BAD | 79 | 7.5 | 11.2 | 1.33 |
| Carbon Powder | 0.75 | 1.38 | 0.026 | 41.3 | 70.2 | 2.75 | 193.0 | 917 | 896 | 690 | 686 | 218.5 | 7.5 | 10.9 | 0.47 |
| Cast 954 | 0.875 | 1.38 | 0.021 | 89.9 | 158.4 | 1.96 | 310.5 | 889 | 892 | 845 | 832 | 52 | 5.5 | 20.5 | 3.23 |
| Cast 954 Rep | 0.875 | 1.38 | 0.021 | 91.5 | 161.3 | 2.02 | 325.8 | 890 | 894 | 845 | 831 | 54 | 5.5 | 21.6 | 3.26 |

Regardless of particle composition, radiation inter-particle heat transfer limits close packed beds of particles to an effective thermal conductivity of less than 1 BTU/ft-hr- at temperatures under 2000° F.

In situations where dielectric properties are unimportant, copper-containing materials may be used as a heat transfer medium. The alloy must have high thermal conductivity and resist oxidation at elevated temperatures. Aluminum bronze and copper-chromium alloys are excellent candidates for this service. Such alloys can be used either as machined components or cast directly into the internal spaces of a heater.

In the present heater design, the internal heat transfer medium will operate in the vicinity of 1800° F. internal (or core) temperature. The table below depicts the solidus temperatures of a range of copper alloys, indicating that only a 100° F.-200° F. temperature difference exists between the service temperature and solidus. Copper alloys operated within this range of temperatures will exhibit softness and flow by creep deformation due to gravity. Such flow will result in an intimacy with the internal components of a heater and substantially reduce interfacial heat transfer resistance. Machined components, used in the construction of a heater, will therefore creep deform at service temperature and flow to occupy interstitial spaces. The intimacy that results can resemble a casting, without the difficulties of feeding and gas expulsion. The proper clearance to avoid hoop stress development in the envelope within the heated region during heat-up must be used. Further, alloy creep will result in the loss of this clearance during subsequent heat and cooling cycles. The insertion of thin walled "crush tubes" can be used to accommodate internal stress development during heating.

Further, the service temperature is sub-solidus and therefore provides higher thermal conductivity than would be otherwise obtained with a liquid. A solid metal is far less reactive with other metals in the heater. Reactivity is an important consideration because most molten metals are reactive with the atmosphere and will solubilize other metals that are present.

This improvement consists of a solid metallic internal heat transfer medium that has high thermal conductivity and resistance to oxidation and scaling at service temperature. Such service temperature is 100° F.-500° F. below the solidus of the metal. Preferably, it is capable of flowing to occupy available interstitial space within the heater during operation.

Such a metal is substantially un-reactive with other materials used within the heater. Copper alloys with aluminum and chromium that are capable of forming stable coherent and protective oxides at service temperature are excellent candidates for heat transfer media. Strength is not a consideration for this application.

Internal interfaces also inhibit heat transfer. The effective thermal conductivity of a solid-solid planar intimate interface has been cited in the literature is approximately 102 BTU/hr-ft-° F. Establishing a chemical bond between the heat transfer surfaces can eliminate such resistances. In the case of a steel sheathed heat producing element in a copper alloy heat transfer medium, the sheath of the heater can be aluminized to a thickness of 3-5 mils, inserted into the copper alloy, and heated to a temperature sufficient to melt the aluminum (approximately 1220° F.). The aluminum will alloy with the copper and form a contiguous interface.

Heater Heat Transfer Alloy Candidates

| Alloy | Liq/Sol, ° F. | K, BTU/ft-hr-° F. | A, $\times 10^{-6}$ in/in° F. |
|---|---|---|---|
| 91 Cu-9 Al | 1908/1890 | 35 | |
| 95 Cu-5 Al | 1940/1920 | 48 | |
| 97.7 Cu-1.5 Si | 1940/1890 | 33 | 9.9 |
| 96 Cu-3 Si | 1880/1780 | 21 | 10.0 |
| 88 Cu-9 Al-3 Fe (9A) | | 34 | |
| 89 Cu-10 Al-1 Fe (9B) | | 36 | |
| 85 Cu-11 Al-4 Fe (9C) | | 41 | |
| 91 Cu-7 Al-2 Fe | 1940/1910 | 44 | 9.0 |
| 91 Cu-7 Al-2 Si | 1840/1800 | 26 | 10.0 |
| 97.9 Cu-1.9 Be-0.2 Ni | 1587/1750 | 34-68 | 9.3 |
| Cu | 1981/1949 | 226 | |
| 30 Cu-67 Ni | 2460/2370 | 15 | |

Figure 2:
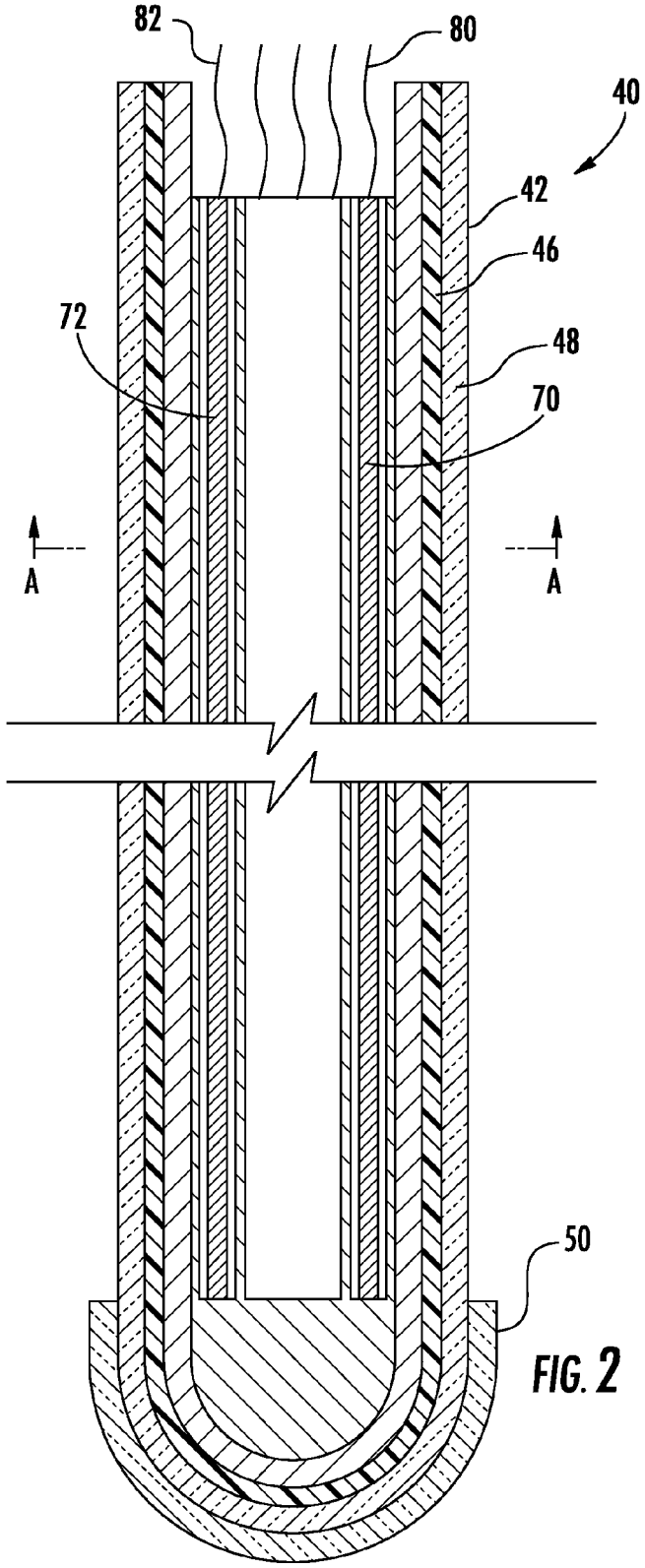
FIG. 2 is a cross-sectional view of an electric heater assembly showing heat transfer material and heaters containing electric heaters in accordance with the invention.

A heater in accordance with the invention is illustrated in FIG. 2. Heater 40 comprises a tube 42. In the embodiment shown in FIG. 2, tube 42 is comprised of a metal or metalloid layer 46 and a molten metal protective layer 48. The molten metal protective layer is only necessary when the heater is used for heating molten metal such as molten aluminum, which would attack the metal layer 46.

Referring further to FIG. 2, there is shown a cross section of two representative heating elements 70 and 72. These heating elements extend substantially the length of the heater. Electrical wires 80 and 82 extend to an electrical power source for energizing the electrical resistance heating elements.

Metal layer 46 can be comprised of any metal. However, when a refractory or protective layer is applied, it is preferred to use a metal or metalloid having a low coefficient of expansion such as referred to herein. Also, molten metal protective layer or refractory 48 may be the same as referred to herein. Further, protective layer 48 may be applied as described herein.

In the embodiment shown in FIG. 2, an end cap 50 is used to protect the end of the heater tube. End cap 50 may be comprised of a refractory or carbon material.

Figure 3:
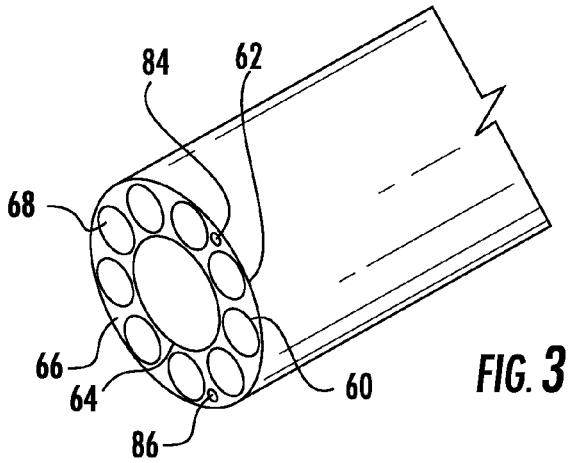
FIG. 3 is a dimensional view showing heat transfer media and receptacles for electric heaters.

The heater of the invention illustrated in FIG. 2 employs heat conduction material comprised of a copper base or copper-containing material, as noted herein. FIG. 3 is an example of body 60 of heat conduction material for use with a cylindrical-shaped heater. It will be noted that body or member 60 has an outer circle 62 and an inner circle 64 defining a circular wall 66 having heating element cavities 68 which in the embodiment shown are circular.

Also, shown in FIG. 3 are holes 84 and 86 used for thermocouple probes (not shown) which may be used to regulate the temperature of the heaters.

Heater elements 70 and 72 that can be used in heater assembly 40 are any heater element that produces sufficient heat. Typically, such heating elements have a metal shell, which is not reactive with body 60. For example, such heaters may have an Inconel® metal shell or stainless steel shell or shells of similar materials.

Figure 4:
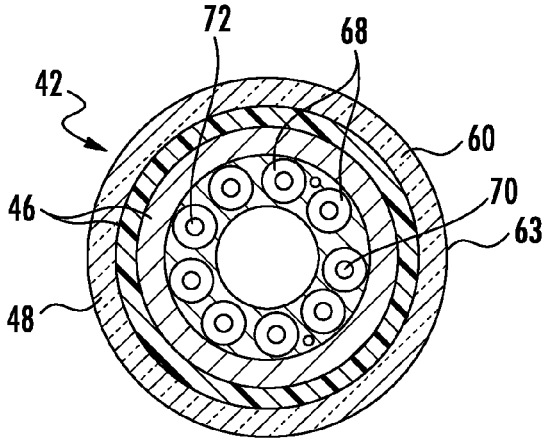
FIG. 4 is a cross-sectional view along the line A-A in FIG. 2.

FIG. 4 is a cross section along the line A-A of the heater assembly of FIG. 2, showing heaters in receptacles 68 in body 60 contained in metal shell 46 which has a refractory coat 48. As noted earlier, pockets of air within the heater assembly are pockets of resistance to heat transfer, and therefore, such pockets should be minimized. Thus, it has been found advantageous to use a thin coating of aluminum between the outer surface 63 of body 60 and the inside of protective tube 42 to aid eliminating pockets of resistance. At temperature of about 1220° F., the aluminum will melt flowing into voids to provide a continuous path for heat conduction from the heating elements. In addition to aluminum, any low melting substantially nonreactive metal can be used.

Figure 5:
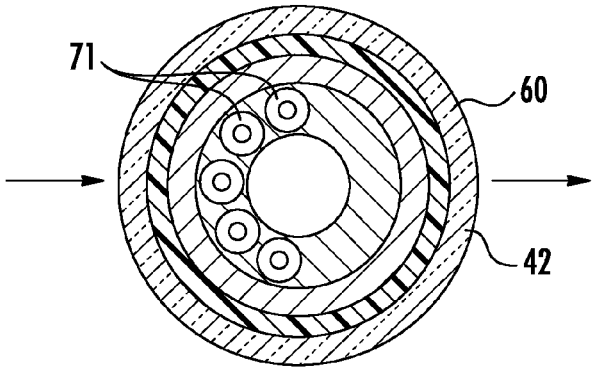
FIG. 5 is a cross-sectional view showing electric heater elements located in direction of maximum heat transfer.

With reference to FIG. 5, there is shown another embodiment of the heater of the invention. Tubular resistance heaters produce heat 360° F. around the envelope. However, there is often a need to direct heat transfer in a specific direction. In FIG. 5, there is shown six heat producing elements spaced on 40° radials to provide a preferred heat distribution over a 240° arc.

The benefit of such geometry is that heat flux can be concentrated in areas of greatest heat transfer. When an array of direct immersion cylindrical heaters is immersed in a flowing stream of aluminum, for example, for the purpose of heating the stream, the local heat transfer coefficient varies as a function of circumferential position relative to the approach direction of the flowing stream.

Heat transfer occurs at a greater rate on the approach side of the heater rather than on the trailing surfaces. Thus, this design provides greater heat flux on the approach side to exploit improved heat transfer.

This method is useful also in heating molten metal flowing in a trough where it is desired to direct the heat towards the molten metal and away from the outside walls of the trough. This embodiment of the invention is illustrated in FIG. 5 where molten metal is shown flowing towards the heater assembly. Heating elements 71 are shown arranged to transfer heat in the direction of the advancing metal for most efficient heat transfer.

It will be understood that the heaters may be used without the refractory coatings, and such is contemplated within the purview of the invention.

Because the refractory coatings on the heater assembly are important, it is necessary to ensure that the coatings are free of cracks and other like flaws which would permit molten metal or metal vapor to reach metal layer 46. Thus, a method to nondestructively evaluate a heater envelope refractory coating for defects is required for heater envelope use. As noted, such defects include cracks and interconnected porosity that extends from the top or refractory coat surface through to the top coat and/or bond coat interface or beyond. Thus, there is a great need for a method to evaluate the refractory coatings. A first method which has been found to be satisfactory is potentiostatic method. This method involves an electrical discharge between an electrode and a metal refractory coated envelope within a reduced pressure environment in the presence of an ionization gas. The metallic substrate of the envelope is electrically conductive, while the refractory topcoat, e.g., yttria stabilized zirconia, is not, except for surface charging. Such an envelope is placed in a chamber, whereby the refractory coated exterior surface of the tube or envelope projects from a surface of the chamber wall which is electrically insulating. The chamber, which has been evacuated, is backfilled with an ionization gas. An electric potential is applied between the metallic substrate or interior of the envelope and an electrode placed within the chamber. In the absence of a coating defect extending through to the conductive metallic substrate of the envelope, surface charging will result in a corona forming that is substantially uniform around the refractory coated surface of the envelope. If a crack or porous network allows the ionization gas to contact the conductive metallic substrate, however, local ionization will occur due to charge concentration and high current density. This will be visible as a bright spot. Only defects extending to the conductive substrate of the envelope, or to an area of coating so thin that the local dielectric properties are breached, will behave in this manner.

The purpose of evacuating the chamber prior to the introduction of the ionizing gas is to evacuate any defects in the coating and permit ionization gas to enter. At low absolute pressure, Knudsen diffusion will control diffusion of the ionizing gas.

Typical operating parameters are: ionizing gas—neon, potential—1000 to 5500 VAC, initial vacuum—5 mm Hg, ionizing gas backfill and operating pressure—45 mm Hg.

In a second method of evaluation of the refractory coat, an aqueous conduction method subjects the envelope to a low (<25 V) potential in a conducting liquid. Such a liquid can consist of water and potassium chloride, or water and other ionic compound solutes with a high ionization potential.

The envelope to be evaluated is placed in the conducting liquid, with or without a surfactant and vibration, e.g., ultrasonic vibration, is applied to promote liquid intrusion into small defects. A potential is established between the envelope and a second electrode. If a defect exists, and the conducting liquid intrudes it, current will flow. Quantification of the current flow at a particular potential can yield information regarding the size of the defect.

The second electrode is preferably an inert material, for example, carbon or platinum, and alternating current is preferred to direct current. A defect consisting of a single crack will produce a current flow of approximately 80 mill amperes at a potential of 6 volts.

Failure of the refractory coating material will occur when a discontinuity exists in the top coating that permits aluminum, for example, to contact and chemically react with elements within the bond coating and/or substrate material. Such reaction produces a volume change that ultimately leads to delamination and exfoliation of the top refractory coating. A point defect arises in situations where a localized reaction occurs without delamination, either of which comprises the coating to the extent that failure results.

Interconnected porosity or as sprayed cracks (discontinuities) constitutes a diffusion path for aluminum. Unless discontinuities are on the order of several tens of mils in width, capillary counter-pressure prevents liquid aluminum from intruding such a discontinuity. Washburn Equation gives the magnitude of this counter pressure:

$$P(r)=-2\sigma\cos\theta/rg,$$

where:

P=capillary intrusion pressure

σ=surface tension of fluid

θ=contact angle fluid/solid r=capillary radius

For example, in the case of a discontinuity in a yittria stabilized zirconium coating submerged in aluminum at an immersion depth of 12 inches. The metallostatic pressure exerted by the melt is capable of intruding a crack with an effective diameter on the order of 135μ (0.0053 in.) or greater. Most cracks have been measured to be much smaller than 0.005 in. Since the crack or pore is "blind", the added complication of air displacement makes intrusion by molten aluminum even less likely.

Alternatively, aluminum vapor is capable of both ordinary and Knudsen diffusion in small discontinuities. The capillary counter-pressure intrusion criterion does not apply. If a chemical sink reaction exists for diffusing aluminum vapor species, transport of aluminum is maintained and a failure results. Such a reaction can occur between bond coat species and/or the substrate to form the respective aluminides.

In-service cracks may form due to thermally induced mechanical stress resulting from non-uniform heating and differential thermal expansion. Thus, there is a great need for a solution to this problem. It has been discovered that an as-sprayed tube can be thermally cycled to intentionally induce cracking. Such cracking results in a relaxation of stress. At some point, insufficient stress exists for the nucleation or growth of cracks, and repeated thermal cycling fails to contribute to additional cracking. This stress level will be the crack saturation/propagation inhibition parameter.

Tubes can be thermally cycled to induce cracks. In a sufficiently oxidizing environment, a protective oxide can form that prevents aluminum vapor diffusion. Alternatively, a chemically stable compound can be made to form in the crack that accomplishes the same diffusion arrest effect, which is referred to as the crack/fill mechanism. This may be accomplished by intentionally forming cracks in the refractory coating.

Cracks may be formed by cyclic heating and cooling of a refractory coated tube from within to lower stress. The temperatures may range between 500 to 2300° F. The cracks then may be filled by the use of gas phase oxidizing environment to oxidize the bond coating at the base of the crack. This may be accomplished by use of steam or $N_2O$. Electrochemical oxidation of the bond coat at the base of the crack can be used to fill cracks. Solid oxidants are $SiO_2$, for example, carbon based material (hydrocarbon intrusion), siloxane, sputter coating (Mg, C) or ALD (Argonne National Lab Atomic Layer Deposition process) may be used. In yet another embodiment, cracks are allowed to form from intentional pre-service thermal cycling, followed by one of the following post crack treatments:

a. oxidation of the bond coat using high temperature air or oxidizer;

b. electrochemical or chemical oxidation of the bond coat;

c. Mechanical intrusion of sufficiently small particles, i.e., boron nitride;

d. intrusion of magnesium vapor, followed by oxidation to MgO;

e. intrusion of carbon into pores (may react in-situ to form $Al_4C_3$)

f. use of atomic layer deposition to intrude metal oxides g. use of sputter coating to intrude metals or carbon;

h. incorporation of "reducible oxide" into pores/cracks to form in-situ $Al_2O_3$.

As noted herein, yttria stabilized zirconia (YSZ) is used as a topcoat material because it has a coefficient of expansion value that is numerically compatible with the titanium substrate. This property of YSZ maintains low top coat/substrate shear stress during heating, and is partially responsible for satisfactory topcoat adhesion to the substrate. In the case of an immersion heater for use in molten aluminum, the topcoat must also be essentially unreactive with aluminum.

In situations where a YSZ-Ti heater envelope is exposed to a substantially quiescent aluminum melt, it was found that stability of the YSZ topcoat was satisfactory. When the heater envelope was presented with a flowing stream of molten aluminum, however, YSZ degradation was found to occur on certain areas of the envelope surface. It was further discovered that heater envelopes in contact with quiescent aluminum developed a thin layer of alumina powder on the surface, which is not present in cases involving envelopes exposed to a flowing stream.

The following chemical reactions apply to a situation where YSZ is in contact with molten aluminum at 1000° K (1340° F.):

$$\tfrac{3}{2}ZrO_2 \rightarrow frax;\mathbf{3};\mathbf{2}Zr+frax;\mathbf{3};\mathbf{2}O_2 \quad \Delta G^\circ=+323\text{ kcal}$$

$$2Al+\tfrac{3}{2}O_2 \rightarrow Al_2O_3 \quad \Delta G^\circ=-322\text{ kcal}$$

The net reaction is:

$$2Al+\tfrac{3}{2}ZrO_2 \rightarrow \tfrac{3}{2}Zr+Al_2O_3 \quad \Delta G^\circ=+1\text{ kcal}$$

The corresponding equilibrium constant (k) for the net reaction is:

$$k=(h^{3/2}_{Zr}a_{Al2O3})/(a^2_{Al}a^{3/2}_{ZrO2})=\exp[-1/(1.99)(1000)]=0.999$$

where: a=Raoltian activities and h=Henrian activities.

Due to the near equilibrium conditions exhibited by the alumina/zirconia reaction, the removal of the alumina reaction product would have the effect of driving the zirconia reduction reaction forward, favoring the continued decomposition of zirconia.

This was in fact occurring with the flowing metal stream. In quiescent or near quiescent situations, it is believed that integrity of the alumina layer was maintained and the reduction reaction was essentially terminated. Alumina is essentially passivating or inhibiting the reduction reaction.

YSZ was selected as the topcoat material of choice on the basis of thermal expansion compatibility with the substrate titanium alloy and thermal shock resistance. Alumina's thermal expansion coefficient is only approximately 50-75% of YSZ. Further, it is well known that the thermal shock resistance of alumina is quite poor. Although alumina has excellent chemical stability in contact with aluminum, thermal expansion and thermal shock considerations disqualifies it as an acceptable topcoat candidate. A layer of alumina, sufficiently thick to provide mechanical robustness, would not be adherent to the Ti substrate, particularly when subjected to cyclic heating/cooling.

Thin layers of otherwise brittle material coatings can withstand the elastic and plastic deformation of more flexible substrata. Paint on a metal surface is an example. In the particular situation of a heater envelope, an intentionally applied coherent and adherent layer of sufficiently thin alumina could protect the YSZ from reaction with molten aluminum. Since the wettability of alumina by aluminum is very poor (contact angle>110°), chemical reaction is further inhibited due to poor interfacial contact.

It was found that the air plasma spray (APS) application of an alumina vainer on the surface of a YSZ topcoat was sufficient to protect the heater envelope at high melt velocities. The thickness used was 0.001" to 0.0015". However, the thickness can range from 0.0003" to 0.006". Such envelopes do not exhibit evidence of chemical reaction with a flowing aluminum stream.

Thus, it has been found that the use of an unreactive and thin vainer applied to a YSZ topcoat protects the topcoat from chemical reaction with an aluminum melt. It has been discovered that a chemically stable thin layer (vainer) of material can protect an underlying and thicker layer of material where the ticker material has thermal expansion and elastic modulus compatibility with the substrate and is used to protect the substrate. Thermal expansion compatibility is not a primary requirement because the vainer is thin and therefore compliant to deformation. The essential requirements for this vainer are: thermodynamically stability in contact with aluminum, ability to be applied and adhere to the main layer of coating (YSZ), and reasonable mechanical robustness.

Preferably the vainer material is not wetted by the aluminum melt. In this invention, the alumina vainer can be 0.001" to 0.0015" in thickness, and the main coating layer (YSZ) can be 0.008" to 0.010" in thickness. A 10:1 main coat to vainer thickness ratio is reasonable. Alumina or yttria may be used; however, the cost of yttria is very high. Magnesium oxide, magnesium aluminate, magnesium zirconate, equilibrium fired mullite, and various combinations of these oxides with and without yttria, can also be used.

My U.S. Pat. No. 5,963,580 is incorporated herein in its entirely, as if specifically set forth.

As noted, in molten aluminum systems, thermally sprayed (plasma deposited) refractory coatings have been used to protect metallic substrata from reaction with molten aluminum. In many cases, the substrate is titanium or an alloy of titanium. It is well known that aluminum and titanium are reactive and form titanium aluminide compounds of various stoichiometric ratios. If therefore, aluminum and titanium are placed in contact with each other, aluminide formation reactions occur that destroy the protective integrity of the plasma deposited coating. Such reactions result in a volume change that provokes exfoliation of the refractory coating due to a volume change that accompanies the formation of the aluminides. For example, the density of the cubic polymorph of zirconia is 6.27 g/cm$^3$. Titanium aluminide densities range from 4.1 to 4.7 g/cm$^3$, representing approximately 30% more volume than an equivalent mass of zirconia. Commonly encountered aluminides include: $TiAl_3$, TiAl, and $Ti_3Al$.

Further, various alloys of nickel, chromium, aluminum, cobalt, and yttrium are used a "bond coatings" to improve, among other things, the adhesion of the plasma deposited refractory matrix coating with the substrate. Chemical reactions between aluminum and elements in these bond coatings also produce intermetallic compounds with similar detrimental effects on the integrity of the refractory coating.

Continuous porosity, cracks, and other discontinuities in the refractory matrix coating itself are frequently responsible for allowing contact between the titanium substrate and surrounding aluminum alloy.

Such cracks provide a transport path for infiltrating molten aluminum to contact and react with underlying metallic species to form intermetallic compounds.

It has been determined that aluminum alloys containing approximately 0.2% magnesium or greater will infiltrate cracks and pores within the refractory matrix coating that are accessible from the surface. The effect has also been observed in aluminum alloys that do not contain magnesium, however, infiltration occurs at a higher temperature. Such infiltration will occur approximately 24-48 hours after the initial exposure of the coating to molten aluminum.

If the coating is allowed to remain exposed to molten aluminum, migration of aluminum through interconnected pores and cracks within the coating will take place. Failure of the coating occurs when aluminum contacts the metallic bond coat layer or substrate resulting in coating exfoliation due to chemical reaction.

The coated object can be removed from an infiltrating melt following a pre-determined interval allowing for controlled infiltration of molten aluminum to a specific depth within the refractory matrix coating. Such infiltration must not extend to the bond coat layer or failure will occur. It has been found that the infiltration time is approximately a linear function of exposure time following an initial incubation.

Certain metal oxides are incoherent and exhibit linear oxidation, that is, the oxidation rate is constant and the oxide thickness increases as an approximate linear function of time. Incoherent oxides will characteristically oxidize completely if allowed to remain in an environment where the chemical potential of oxygen is sufficiently high. In the case of this invention, an infiltrating metal or alloy is selected that is capable of forming an incoherent oxide. Such an oxide will develop fully and ultimately inhabit the pores or cracks once occupied by the progenitor infiltrating metal.

In another embodiment of this invention, a liquid reagent is used to oxidize the infiltrating melt. Such a reagent is concentrated hydrogen peroxide in the case of oxidizing an infiltrated aluminum-1% magnesium melt. Alternatively, oxidizing reagents can be used to convert the infiltrated melt into an intermediate oxidation product before total conversion to an oxide occurs. An example of such a reagent is sodium hydroxide that will convert aluminum metal to aluminum hydroxide or magnesium metal to magnesium hydroxide, which can ultimately be thermally converted to a full oxide.

A candidate metal or alloy for infiltration will first be capable of infiltration. Typically such a metal or alloy will have a low surface tension (<700 Dynes/cm) and low viscosity (~1 cP). Second, the metal or alloy will form an incoherent oxide with an oxidation rate that is not kinetically self-limiting. Finally, the oxide that is created must be energetically stable in the melt system of use.

While the invention has been described in terms of preferred embodiments, the claims appended hereto are intended to encompass other embodiments, which fall within the spirit of the invention.

Having described the presently preferred embodiments, it is to be understood that the invention may be otherwise embodied within the scope of the appended claims.

What is claimed is:

1. A method of rendering a refractory coating on a metal substrate impenetrable by molten metal, the method comprising the steps of: (a) applying a refractory coating to a metal substrate; (b) stressing the coating to relax residual stresses; (c) infiltrating aluminum or an alloy thereof into cracks or pores in the refractory coating to a depth which avoids reaction with the metal substrate; and (d) converting the infiltrated aluminum or alloy thereof into cracks and pores to an oxide which occupies said cracks and pores, thereby rendering said refractory coating impenetrable by molten metal.

2. The method in accordance with claim 1 wherein the metal substrate is titanium.

3. The method in accordance with claim 1 wherein the metal substrate is plasma sprayed.

4. The method in accordance with claim 1 wherein the metal substrate is thermally stressed.

5. The method in accordance with claim 1 wherein the metal substrate is mechanically stressed.

6. The method in accordance with claim 1 wherein the infiltrated aluminum is converted to aluminum oxide by treating with an oxidizing agent selected from the group consisting of $H_2O_2$, NaOH, KOH, $KMNO_4$, $O_2$, and $N_2O$.

7. The method in accordance with claim 1 wherein the infiltrated aluminum is converted to aluminum oxide by heating in an oxidizing atmosphere.

8. A method of rendering a refractory coating on a titanium substrate impenetrable by molten aluminum, the method comprising the steps of: (a) plasma spraying a refractory coating onto a titanium substrate; (b) stressing the coating to relax residual stresses; (c) infiltrating aluminum or alloy thereof into cracks or pores in the refractory coating to a depth which avoids reaction with the metal substrate; and (d) converting the infiltrated aluminum to an oxide by treating with NaOH or $H_2O_2$, which oxide occupies said cracks and pores, thereby rendering said refractory coating impenetrable by molten aluminum.

* * * * *